US005845845A

United States Patent [19]

Merke et al.

[11] Patent Number: 5,845,845

[45] Date of Patent: Dec. 8, 1998

[54] FLUIDIC CIRCUIT WITH ATTACHED COVER AND METHOD

[75] Inventors: Joseph P. Merke; Melvyn J.L. Clough, both of Columbia; Qin Zou, Baltimore; Gabriel Ariyanayagam, Columbia, all of Md.

[73] Assignee: Bowles Fluidics Corporation, Columbia, Md.

[21] Appl. No.: 802,682

[22] Filed: Feb. 19, 1997

[51] Int. Cl.[6] ..... B05B 1/08

[52] U.S. Cl. ..... 239/1; 239/589.1; 239/600

[58] Field of Search ..... 239/600, 284.1, 239/589.1, 1; 137/836, 839, 835

[56] References Cited

U.S. PATENT DOCUMENTS

| | | | |
|---|---|---|---|
| 2,443,101 | 6/1948 | Flynn et al. | 239/552 X |
| 3,507,275 | 4/1970 | Walker | 239/589.1 X |
| 4,185,777 | 1/1980 | Bauer | 239/589.1 X |
| 4,508,267 | 4/1985 | Stouffer | 239/589.1 X |
| 4,569,364 | 2/1986 | Bauer | 239/589.1 X |
| 4,721,251 | 1/1988 | Kondo et al. | 239/600 X |

*Primary Examiner*—Kevin Weldon
*Attorney, Agent, or Firm*—Jim Zegeer, Esq.

[57] ABSTRACT

A fluidic oscillator and method in which a first molded portion comprises a first part having an oscillator circuit silhouette formed in one surface. The oscillator circuit silhouette has a power nozzle, an oscillation chamber, with upstream and downstream ends, a power nozzle at the upstream end adapted to receive a liquid under pressure and an outlet to ambient at the downstream end, and oscillation inducing elements in the oscillation chamber. A closure seal plate part is hingedly connected to the first part such that the closure seal plate can engage the oscillation silhouette. A second molded portion has a recess adapted to forcibly receive the first portion with the closure seal plate engaging the oscillation silhouette. Interfitting protuberances and recesses prevent sliding between the first part and the closure seal part when they are forced into the recess.

12 Claims, 5 Drawing Sheets

FLUIDIC CIRCUIT WITH ATTACHED COVER AND METHOD

The present invention relates to a fluidic circuit with a seal cover plate and method of making same.

BACKGROUND AND BRIEF DESCRIPTION OF THE INVENTION

In U.S. Pat. No. 4,185,777, owned by the assignee hereof, there is disclosed fluidic devices of simple construction which can be quickly and efficiently mass produced. In that patent, a fluidic device silhouette is formed as recesses in an element surface of a body member. The recesses are sealed by an abutting surface of a housing member which is continually pressed against the element surface thereby eliminating the need for adhesive material or other extraneous fasteners. The continuous pressing together of the two surfaces form a pressure seal which is accomplished by force-fitting the two members together in a suitably contoured housing. In the manufacturing operations under this patent, fluidic circuits typically used in windshield washer nozzles and other applications are manufactured in the shape of a rectangular parallelpiped (or chip). The feedback channels are usually contained in the fluidic geometry or silhouette formed in one surface of the parallelpiped. The entire chip is then installed in a rectangular slot in a housing member designed to accept the circuit. A flat roof or floor of a slot is required to properly seal the circuit. By using this approach, the feedback channels are included in the geometry or silhouette molded in the chip. In regards to the fluidic sealing surfaces, the fluidic surface needs to be sealed to avoid a short circuit. A sliding into a slot does not always ensure surface-to-surface flatness. Crushed ribs are smeared and non-effective in a slide-in operation.

In regards to styling concerns, a thicker insert or circuit chip would require a larger slot in the housing which then acts as coring in the plastic part and decreases possible sinks in the part. The fluidic chip does not have to rely on the mating surface of the housing being free of sinks.

THE PRESENT INVENTION

The present invention solves these problems by providing a fluidic circuit with a cover, preferably attached and which is folded over the circuit and includes interfitting abutments to keep the parts aligned and together while sliding into a slot or mating housing. The cover or circuit may include crush ribs which would be perpendicular to the line of insertion but sandwiched to avoid smear. Moreover, according to the invention, the cover would permit constant cross-section over the circuit area for better seal when made by current injection molding processes. Finally, the invention provides ability to change the spray angle by changing the angle on the fluidic circuit insert and cover.

The object of the invention is to provide an improved fluidic circuit and method of making and sealing same.

Another object of the invention is to provide a method of sealing that avoids shearing effects on the seal surfaces.

A further object of the invention is to provide a method of sealing which avoids short circuits and avoids sliding of a circuit into a slot where crush ribs are smeared and are rendered ineffective in a slide-in operation.

A further object of the invention is to provide a fluidic element which has its seal surface formed integral thereof and hinged and folded over into sealing relation prior to insertion into a recess in a device housing.

A further object of the invention is to provide squeezability of a seal useful in blind-slot and through-slot designs and the ability to change spray angles using a common circuit.

BRIEF DESCRIPTION OF THE DRAWINGS

The above and other objects, advantages and features of the invention will become more apparent when considered with the following specification and accompanying drawings wherein.

DETAILED DESCRIPTION OF THE INVENTION

Figure 1:
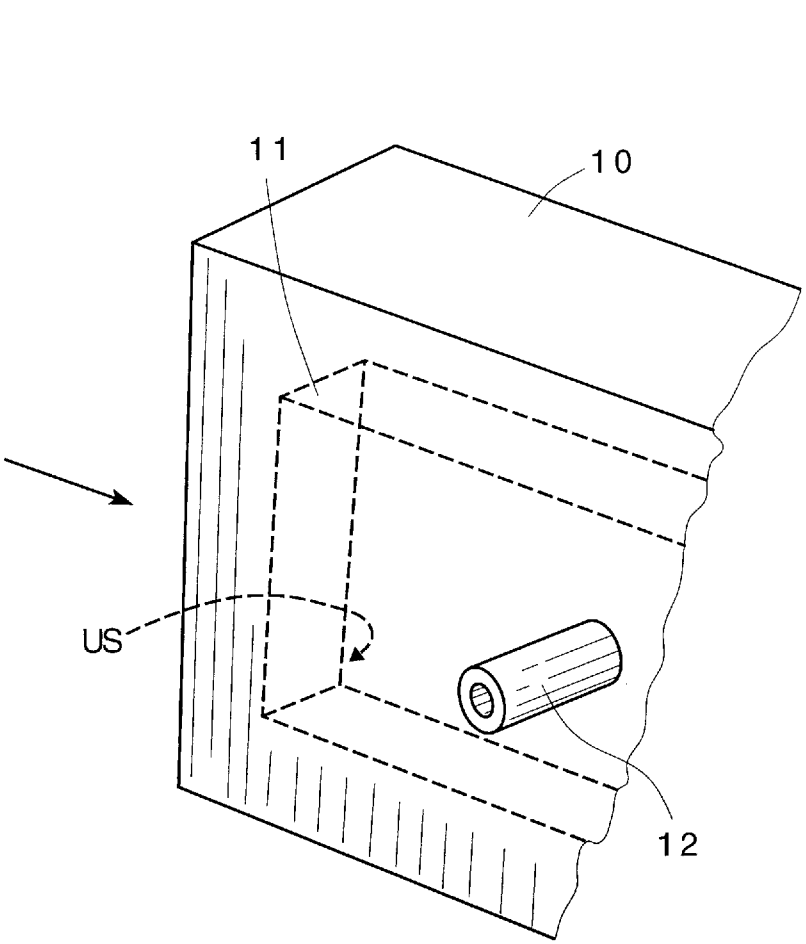
FIG. 1 (PRIOR ART)
FIG. 1 is an isometric schematic illustration of the technique and process disclosed in U.S. Pat. No. 4,185,777 and hence is deemed prior art.
Figure 2:
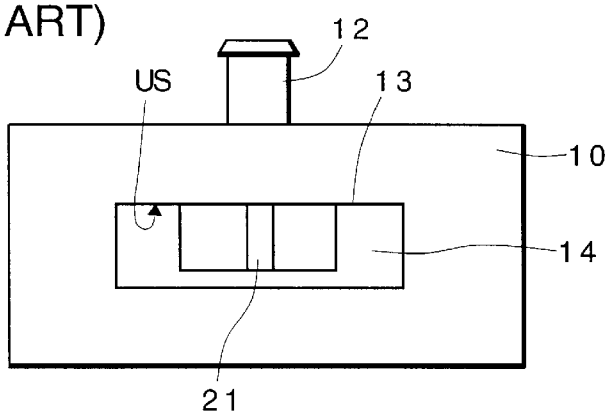
FIG. 2 (PRIOR ART)
FIG. 2 is an end view showing the fluidic insert of FIG. 1 inserted in the housing and is likewise deemed to be prior art and within the teaching of U.S. Pat. No. 4,185,777.
Figure 4:
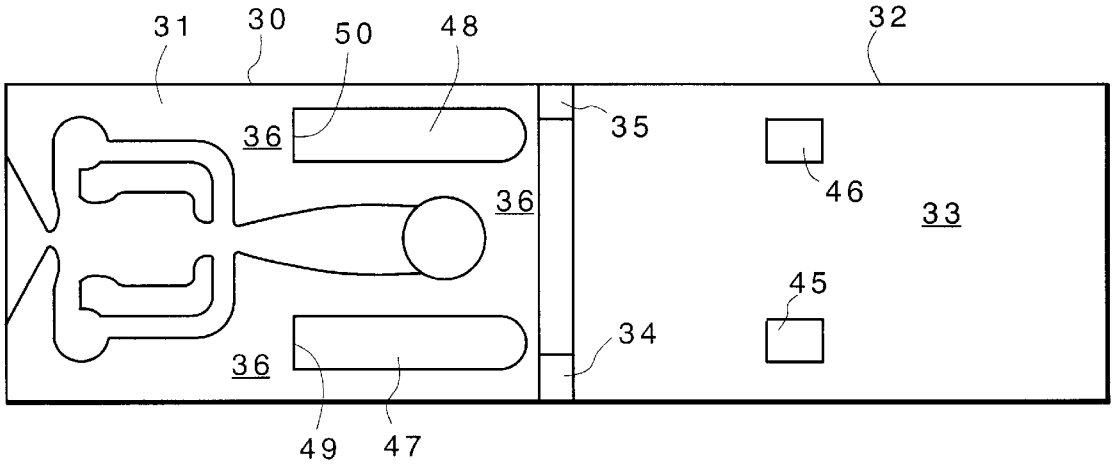
FIG. 4 is a top plan view of the fluidic chip showing the silhouette of the fluidic oscillator and its attached seal cover.
Figure 3:
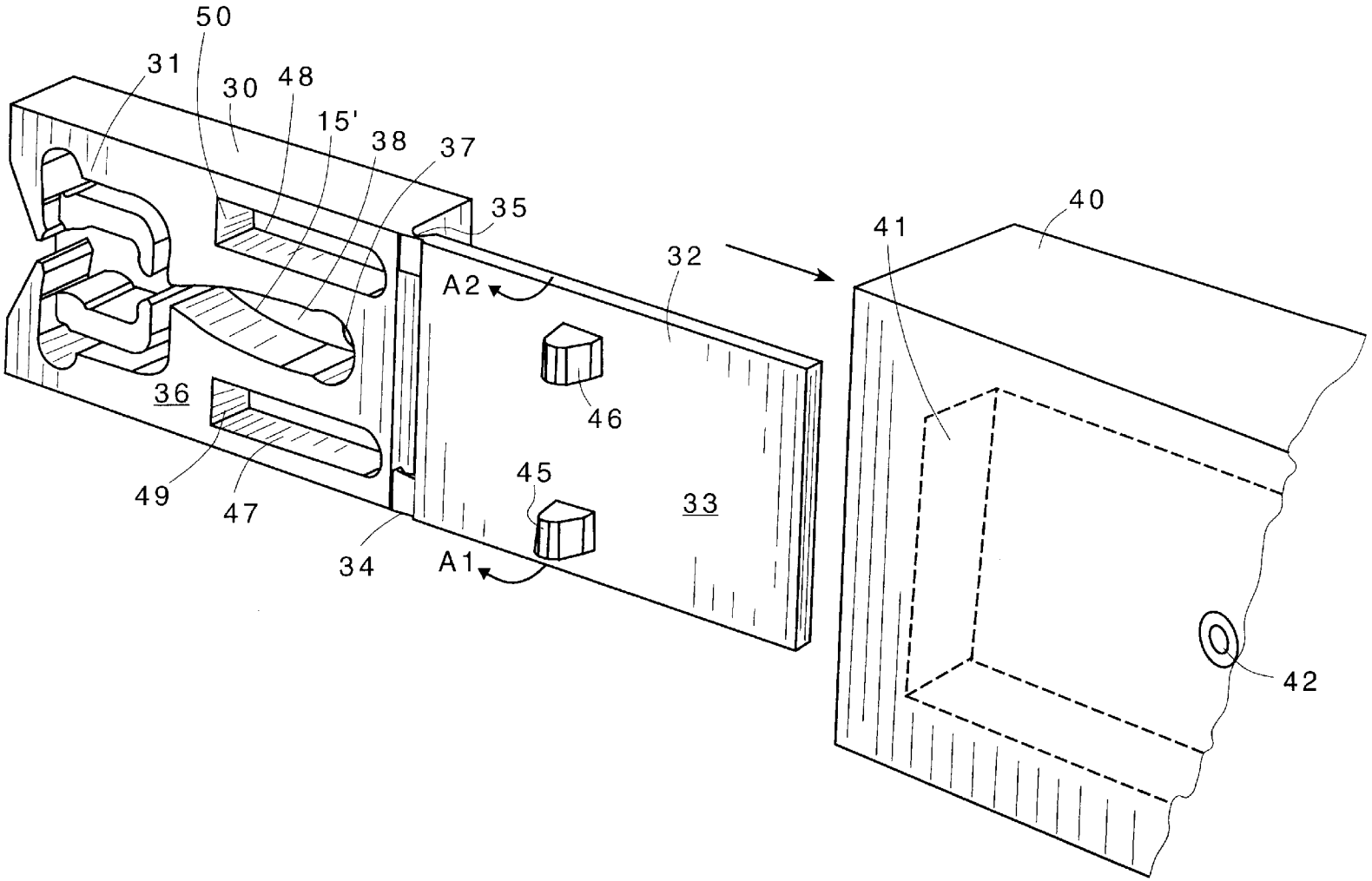
FIG. 3 is an exploded perspective view illustrating the invention and the method thereof.

Referring now to FIGS. 1 and 2, a prior art technique is illustrated in which a molded housing 10 has a recess 11 formed therein (shown in dotted lines) and a fluid input tube 12 molded therein.

Recess 11 is adapted to receive a molded fluidic circuit element 13 which has a fluidic silhouette 14 molded in a surface S thereof. The fluidic silhouette in this case is a pattern of a fluidic oscillator of the type disclosed in Stouffer U.S Pat. No. 4,508,267, but the invention is applicable to all types of fluidic devices where the fluid circuit is formed in a surface and needs to be sealed. The fluidic oscillator device is formed as recesses in the surface of member 13. In this exemplary example, the recesses include a power nozzle 15, an interaction chamber 16 having shaped sidewalls which are designed to induce the formation of control vortices. Control passages 17 and 18 lead to control ports 19 and 20. Power nozzle 15 issues a jet of fluid, which can be a liquid, a gas or a mixture of liquids and gases which initially sets up a system of vortices which, through interaction with the control passages and the control ports, induces the jet of fluid to rhythmically oscillate back and forth and issue into ambient through an outlet portion 21 which has a pair of diverging walls 22, 23. The surface S in which the silhouette of the oscillator circuit is formed is a seal surface which may have sealing ribs formed therein and is adapted to seal with the upper surface US of recess 11. These sealing surfaces US and S need to be sealed to avoid a short circuit. Sliding of the element 13 in the direction of the arrow into slot or recess 11 does not always ensure a surface-to-surface flatness. Crush seal ribs are sometimes smeared and not effective in a slide-in operation; and, as disclosed in U.S. Pat. No. 4,185,777, it is the sealing or the abutting surfaces of the cover member which is continually pressed against the element surface that eliminates the need for adhesive material. Sometimes, the control or feedback channels are contained in the fluidic geometry or silhouette when the unit is installed into a slide-in recess or housing member designed to accept it.

A thicker insert (circuit) would require a larger slot in the housing which then acts as coring in the plastic housing part and decreases possible sinks in the part.

According to the present invention, the fluidic circuit is formed as recesses in a surface of a body member. A cover member which is placed in abutting relation with the surface over the fluidic circuit, and then the unit is forcibly slid or press fitted into the recess or cavity formed in the housing so that cover member tightly engaging the surface to effect a positive fluidic seal along the abutting surface without any sliding or shear forces acting between the abutting surfaces of the cover member and the surface of the body member in which the fluidic circuit is formed. In a preferred embodiment, the cover is molded with the fluidic circuit body member and it is coupled thereto by one or more hinge elements to keep the parts aligned and together while sliding into the slot on the mating housing recess. The cover or circuit may include crush ribs which would be perpendicular to the line of insertion but sandwiched to avoid shear. The cover also permits constant cross-section or circuit area for better sealing when made by injection molding processes. Also, the invention includes the ability to change the spray angle by changing the angle on the insert and cover. Thus, as will appear more fully hereafter, the sandwiching of seal crush ribs, the use of the attached parts as one unit providing constant cavity identification and adjustability and squeezability of the seal is useful in blind-slot and through-slot designs. The invention also has the ability to change a spray angle using a common circuit.

Referring to FIGS. 3–8, the fluidic element 30, having a silhouette essentially identical to the silhouette shown in FIG. 1, has hingedly formed therewith a seal plate member 32 which has a sealing surface 33 and hinge elements 34, 35. The seal plate or cover member 32 is adapted to be folded over in the direction of the arrows A1, A2 with sealing surface 33 in sealing engagement with the surface 36 of the fluidic device formed in the surface 31 of element 30. Seal ribs may also be formed in the surface 33 if desired. A fluid feed hole or aperture 37 is formed in opposite wall 38 of the power nozzle 15'.

Housing member or portion 40 has a recess 41 which is adapted to receive the body member or part 30 with the seal plate or part 32 folded over as described earlier with the seal surfaces abutting and inserted without any sliding or shear forces acting between the abutting surfaces of the cover member and the surface of the body member in which the fluidic circuit is formed. The body member 30 and cover member 32 are inserted and seated in the recess 41 until the fluid feed hole or aperture 37 in wall 38 is in alignment with a fluidic feed input tube 43 formed in the opposite wall of the recess 41.

While hinge elements 34, 35 preclude sliding affects between the surfaces 36 and 33, in order to be positively assured of no sliding, one or more abutment members 45, 46 project from seal surface 33 and are adapted to fit in recesses or slots 47, 48 and engaged the forward ends 49 and 50 of the slots 47, 48 so as to prevent any sliding movement whatsoever when the cover 32 is folded on hinges 34, 35 to where surfaces 33 and 36 are in abutting relation.

Figure 5:
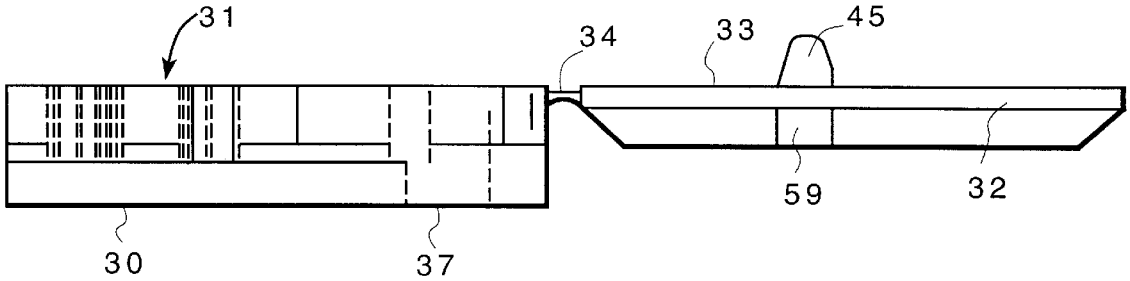
FIG. 5 is a side elevational view with the dashed lines showing the internal silhouette edges.
Figure 6:
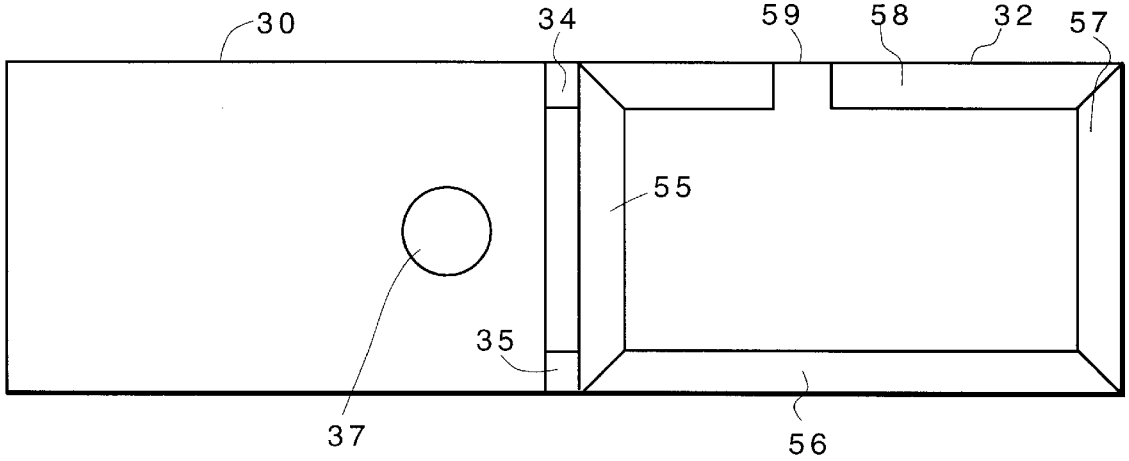
FIG. 6 is a bottom plan view of the fluidic insert and its hinged seal member or portion.
Figure 7:
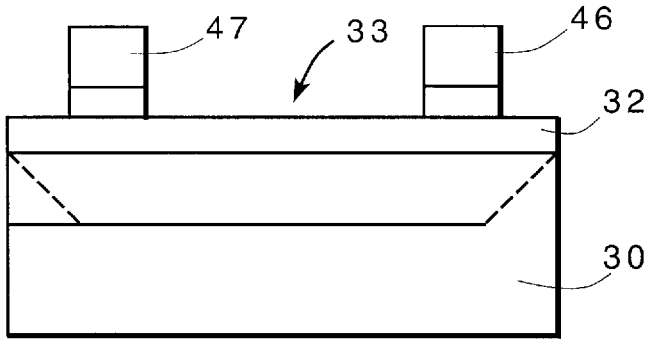
FIG. 7 is an end view.
Figure 8:
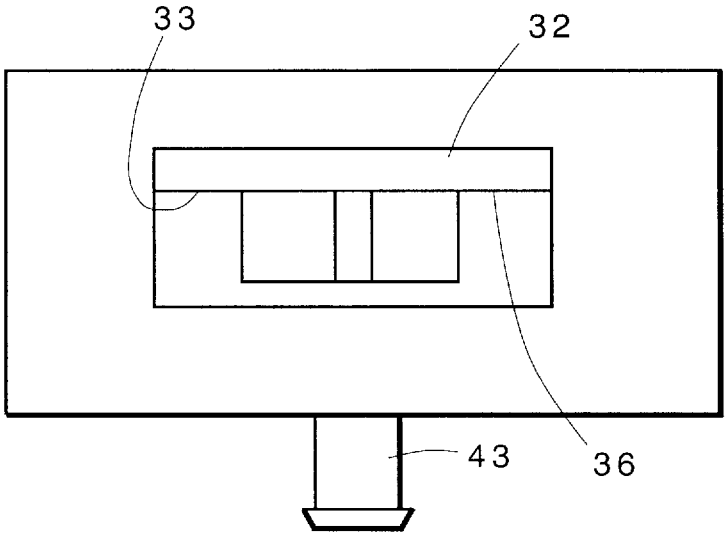
FIG. 8 illustrates the device of FIG. 3 with the fluidic element inserted into a recess in the housing.

As shown in the side elevational view of FIG. 5 and the bottom view of FIG. 6, the cover plate member 32 has its edges 55, 56, 57 and 58 beveled to facilitate insertion into the recess 41. The rectangular portion 59 serves as an abutment for knock-out pin during the molding process. Other knock-out pin areas are provided to facilitate the molding process, but these are not pertinent to the present invention.

Although not illustrated in the drawings, the fluidic elements may be provided with tapered floor (to enhance cold performance in windshield washer nozzles) as disclosed in Bray U.S. Pat. Nos. 4,463,904 and 4,645,126.

Thus, the invention eliminates any sliding action and resulting shear between the cover seal plate and the surface embodying or incorporating the cavities and recesses forming the fluidic circuit, thus always ensuring surface-to-surface flatness in the circuit and a better seal and the avoidance of deterioration and short circuits in the fluidic circuit element itself. Moreover, this requires a slightly larger slot in the housing which then acts as a coring in the plastic part and decreases the possible sinks in the housing part. Moreover, the invention provides the ability to change the spray angle by changing the angle of the fluidic circuit insert and cover in the housing.

While the invention has been shown and described in relation to a particular embodiment and others have been suggested, it will be appreciated that other embodiments, adaptations and modifications of the invention will be readily apparent to those skilled in the art.

What is claimed is:

1. A method of making a fluidic device comprising molding (a) a fluidic device silhouette in a surface of a first member, (b) a closure seal plate as a second member, (c) and a housing having a space for receiving a juxtaposed said first and second members, and forcing said juxtaposed first and second members into said space for receiving while preventing any sliding between said first and second members as said first and second members are forced into said space for receiving.

2. A method of making a fluidic device comprising molding (a) a fluidic device silhouette in a surface of a first member, (b) a closure seal plate as a second member, (c) and a housing having a space for receiving a juxtaposed said first and second members, and forcing said Juxtaposed first and second members into said space for receiving while preventing any sliding between said first and second members as said first and second members are forced into said space for receiving: and wherein said first and second members are formed in one molding with a hinge therebetween and including the step of folding said first and second members on said hinge into said juxtaposed relation.

3. The method defined in claim 1 wherein the step of preventing any sliding between said first and second members is effected by molding one or more stop elements on one of said first and second members and one or more complementary stop abutment elements on the other of said first and second members, said stop elements and said complementary stop abutment elements being in mutual engagement as said first and second members are forced into said space for receiving.

4. The method defined in claim 2 wherein the step of preventing any sliding between said first and second members is effected by molding one or more stop elements on one of said first and second members and one or more complementary stop abutment elements on the other of said first and second members, said stop elements and said complementary stop abutment elements being in mutual engagement as said first and second members are forced into said space for receiving.

5. A method of making a fluidic oscillator comprising molding (a) a fluidic oscillator silhouette in a surface of a first member, (b) a closure seal plate as a second member, (c) and a housing having a space for receiving a juxtaposed first and second members, and forcing said juxtaposed first and second members into said space for receiving while preventing any sliding between said first and second members as said first and second members are forced into said space for receiving.

6. The method defined in claim 5 wherein said first and second members are formed in one molding with a hinge therebetween and including the step of folding said first and second members on said hinge into said juxtaposed relation.

7. The method defined in claim 5 wherein the step of preventing any sliding between said first and second members is effected by molding one or more stop elements on one of said first and second members and one or more complementary stop abutment elements on the other of said first and second members, said stop elements and said complementary stop abutment elements being in mutual engagement as said first and second members are forced into said space for receiving.

8. A fluidic device comprising:

a first molded portion including a first part having a fluidic device circuit silhouette formed in one surface, said silhouette having an interaction chamber with upstream and downstream ends, a power nozzle at said upstream end adapted to receive a liquid under pressure and an outlet to ambient at said downstream end, a second molded portion comprising a closure seal plate; and a third molded portion having a recess adapted to forcibly receive said first and second molded parts with said closure seal plate engaging said fluidic device circuit silhouette.

9. The fluidic device defined in claim 8 including means for preventing sliding between said first and second molded parts when said first and second molded parts are forcibly inserted into said recess.

10. The fluidic device defined in claim 9 wherein said means for preventing any sliding between said first and second members includes one or more stop elements on one of said first and second molded portions and one or more complementary stop abutment elements on the other of said first and second molded portions.

11. A fluidic oscillator comprising:

a first molded portion comprising:

(a) a first part having an oscillator circuit silhouette formed in one surface, said oscillator circuit silhouette having an oscillation chamber with upstream and downstream ends, a power nozzle at said upstream end adapted to receive a liquid under pressure and an outlet to ambient at said downstream end, and oscillation inducing means in said oscillation chamber;

(b) a closure seal plate part;

(c) hinge means hingedly connecting said first part and said closure seal plate part such that said closure seal plate can engage said oscillation silhouette; and a second molded portion having a recess adapted to forcibly receive said first portion with said closure seal plate engaging said oscillation silhouette.

12. The fluidic oscillator defined in claim 11 including means to prevent sliding between said first part and said closure seal part when they are forced into said recess.

* * * * *